US006651471B1

(12) United States Patent
Gasparini

(10) Patent No.: US 6,651,471 B1
(45) Date of Patent: Nov. 25, 2003

(54) SELF-CENTERING OSCILLATING FORK, PARTICULARLY FOR FOUR-POINT ANGLE MEASURING IN A PRESS BRAKE

(76) Inventor: Luciano Gasparini, Via Stortl 11, Istrana (IT), I-31036

( * ) Notice: Subject to any disclaimer, the term of this patent is extended or adjusted under 35 U.S.C. 154(b) by 0 days.

(21) Appl. No.: 09/926,341

(22) PCT Filed: Apr. 7, 2000

(86) PCT No.: PCT/IT00/00128

§ 371 (c)(1),
(2), (4) Date: Jan. 15, 2002

(87) PCT Pub. No.: WO00/62951

PCT Pub. Date: Oct. 26, 2000

(30) Foreign Application Priority Data

Apr. 16, 1999 (IT) ..... TV99A0043

(51) Int. Cl.[7] ..... B21D 7/06; B21C 37/02

(52) U.S. Cl. ..... 72/31.1; 72/389.3; 72/389.6; 72/31.01

(58) Field of Search ..... 72/31.01, 31.1, 72/389.3, 389.4, 389.5, 389.6

(56) References Cited

U.S. PATENT DOCUMENTS 3,209,576 A * 10/1965 Giordano ..... 72/389.3
3,978,706 A * 9/1976 Nakagawa et al. ..... 72/389.5
4,131,008 A * 12/1978 Malatto ..... 72/389.4
4,802,357 A * 2/1989 Jones ..... 72/17.3
4,962,654 A * 10/1990 Zbornik ..... 72/16.7
4,966,029 A * 10/1990 Zbornik ..... 72/379.2
5,365,766 A * 11/1994 Takahashi et al. ..... 72/387
5,584,199 A * 12/1996 Sartorio ..... 72/18.6
5,842,366 A * 12/1998 Klingel et al. ..... 72/31.1
6,266,984 B1 * 7/2001 Gasparini ..... 72/31.11

FOREIGN PATENT DOCUMENTS

JP 62-127125 6/1987
WO WO98/58753 12/1998

* cited by examiner

*Primary Examiner*—David B. Jones

(57) ABSTRACT

Fork of the self-centering oscillating type, particularly for the bending angle measuring, in a pressbrake including at least a fork provided along a matrix or a matrix fractioned element, able to detect the real inclination of the two specular planes of a pressed-bent sheet-plate, each having two detection points, one of which is static and known, and the other one is dynamic. The fork including a forked end and a relative shank which interacts with a position transducer, communicating with a data processing logic unit which controls the pressbrake. The fork being hinged in correspondence with the shank top.

7 Claims, 1 Drawing Sheet

Figure 1:
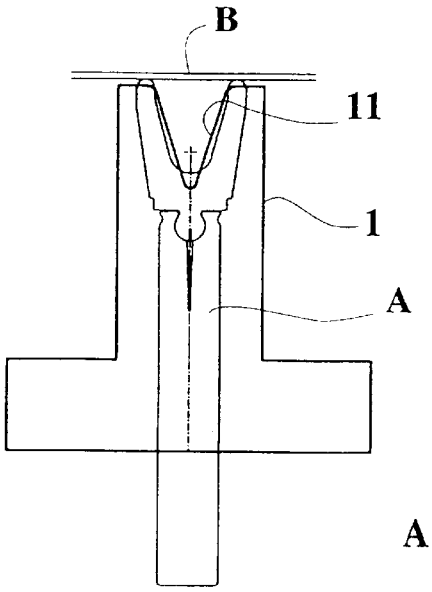

SELF-CENTERING OSCILLATING FORK, PARTICULARLY FOR FOUR-POINT ANGLE MEASURING IN A PRESS BRAKE

This is a nationalization of PCT/IT00/00128, filed Apr. 7, 2000, and published in English.

TECHNICAL FIELD

This invention, has for object an improved forked fork of the self-centring oscillating type, particularly for the bending angle measuring on four points, in a pressing-bending machine, namely a press brake.

The invention finds particular even if not exclusive application in the sheet controlled deformation processes.

BACKGROUND ART

The press brakes find their use in the metal and mechanical industry, and in particular in the metal sheets manufacturing, for obtaining for instance, some differently shaped longitudinal profiles, with the possibility of being taken up again and, each, subjected again to a pressing-bending cycle.

A pressing-bending cycle, for instance, may essentially consist of a tool vertical descent up to contact the underlying sheet rested on the "V"-like matrix, in carrying out the bending, and thus finally, in re-ascending up to a starting position.

For carrying out the described steps, the machine is made up of two parts, respectively a first dynamical one, generally concerning the upper part, and a static one, making up the machine lower part placed on the dynamic part perpendicular line. For what concerns the dynamic part, when carrying out a bending cycle, the tool, made up of a differently shaped blade also of the interchangeable type, performs exclusively a to-and-fro vertical movement, ensured by at least a final oleodynamic cylinder, which determines the descent of an upper cross-beam which supports the tool longitudinally, towards a lower crossbeam, followed by the eventual stop and re-ascent.

In the known solutions, some drawbacks were noticed. These generally concern the bending angle inaccuracy and are anyway related to an objective difficulty of predetermination and detection of the same. Presently, in fact, the traditional system provides that, giving a matrix known total height and a bend hollow depth, as well as the material thickness, the punch lowers for contacting the sheet giving it the required angle. In the machines endowed with numeric control, the punch descent is mathematically calculated according to some parameters set by the operator, and as a consequence, the machine is pre-set for executing the programmed angle. However the result is not always optimal, because such an art, many times leads to obtaining some angles having errors even if limited. This is due to different reasons, such as for instance the thickness of materials, where even a centesimal amount affects negatively the manufacturing. Furthermore, for other aspects, because it is a predetermined theoretical calculation, such a system does not give the possibility of really checking the result, during the bending, with the risk of compromising the whole productive process. A further relevant factor, concerns the material natural spring-back, which is calculated hypothetically and thus for what it can be reliable, it will only get near the real result but will never be considered as a real data. Finally, besides the product faultiness, it should be considered that the desired result can never be obtained during the first working cycle, that is during the first pressing of the cross-beam, but generally, it always requires a second pressing-bending step which intervenes as a correction of the first result.

With the purpose of solving the pointed out problems, there are now on the market some evolved pressing machines, whose target is in one way or the other that of obtaining a manufactured product with the bending angle exactly coinciding with the data required by the operator in the least time possible.

Solely as example, the solution as in European patent 340 167 (Hammerle), in which a bending process according to a given nominal angle with the aid of a bending equipment made up of a punch and a matrix, which is provided with an adjustable bottom according to the angle to be formed, is known. The text points out that the process consists in providing:

- in a first step, the matrix bottom adjustment in height occurs on the basis of the first angle to be obtained, which is a bit larger with respect to the nominal angle given, where the sheet is bent on the basis of this first angle by means of the punch lowering up to the matrix bottom;
- in a second step, the profile is discharged, so that a return of the same to an extended position occurs;
- in a third step the measured angle deriving from the returned and stretched profile, is compared to the first angle and the matrix bottom position is adjusted with a value that corresponds to the nominal angle minus the difference between the angle measured on the released profile and the first angle;
- in a fourth step the bent sheet is pressed with the punch completely again charged against the bottom of the matrix, which will take a correct position in height.

However even this solution is not free from drawbacks. Firstly, it appears an extremely complex machine, not flexible and somewhat oversized, which needs a constant and particular maintenance and setting-up, mainly feasible by highly specialised personnel. As a consequence, for the reference market, there are high costs, above all in relation to the purchase and management of the machine itself. By the qualitative view-point, finally, said solution does not allow to obtain a bending of the sheet with the round edge on the extrados, therefore optimal for the subsequent processings. And in fact, it can considered that in the bending step, using a third dynamic point as standstill mechanic element provided on the matrix bottom, the sheet in logic correspondence tends to deform, flattening, practically crushing, even if lightly, above all in correspondence of the bending angle extrados.

In relation to these and other measuring techniques of the bending angle, it is opinion of the applicant, that the working and above all the measuring step of the bending angle can be further optimized, above all regarding the precision and the reading times, all factors, on which the possibility to intervene effectively for correcting the spring-back of an already pressed-bent sheet depends.

Finalized to solving completely the problems of the known art, the solution as in national application of patent for industrial invention, n. TV97A000083 (Gasparini,), was put on the market. It, substantially, consists of a pressing-bending improved process of the sheet with the bending angle measuring system on four points, and press brake so obtained, in which it is provided:

- the advancement on the work bench of at least one sheet foil, up to intersect the descent vertical axis of the upper cross-beam supporting a punch, towards the underlying matrix sustained by a lower cross-beam; and in which on the intrados of the sheet foil rested on the matrix, at least one feeling means made up of a measuring fork interacting with a position transducer, communicating with a data processing logic unit that manages said press brake; insists permanently;

therefore, in carrying out a first descent step of the upper cross-beam supporting the punch, toward the underlying matrix sustained by a lower cross-beam, pressing-bending the sheet foil and determining a corresponding displacement along the vertical axis of said feeling means, which, interacting with a position transducer, communicates to the computer unit the data relative to the stroke carried out by the same;

at the end, in carrying out at least one partial re-ascent of the upper cross-beam and of the relative punch, carrying out at the same time the return of the feeling means to a former condition;

and still in which, detecting in the first step through said feeling means permanently in contact with the sheet, a different bending angle with reference to the pre-set nominal one, said computer unit ensures the consent to the press brake, not discharging the product thus obtained, to carry out at least a second descent step of the upper cross-beam supporting the punch, towards the underlying matrix up to insist again on the same bending angle, for then proceeding to the product discharging.

Some subsequent and consequential checks, after some test performed on the test bench, required to find improving solutions to the feeling means made up of a measuring fork interacting with a position transducer, communicating with a data processing logic unit that manages said press brake, a device, which is part of the bending angle measuring system.

More in particular it has been observed, that the traditional fork, made up of a monolithic body consisting of a shank on whose end is obtained a fork of the type having two prongs, during the bending angle survey step, does not suit the movement, even light, orthogonal to the bending axis, of the sheet subjected to a pressing-bending cycle.

Notoriously in fact, the sheet during at least one of the aforementioned steps, is subjected to friction on the matrix ends, a phenomenon that concurs even with the small oscillations of the rammer, to move even slightly in one or in the other direction, the sheet.

The sheet movement, additionally, may be required also in other situations. Among these there is the fact that, sometimes, it can protrude abundantly from the bench, creating a so-called "butterfly", original oscillation caused by the material elasticity, that is unavoidably transmitted and concurs with the other working conditions to determine the sheet instability during said manufacturing cycle.

Finally, another condition that can make the sheet further unstable, consists of that often, the surfaces are particularly greased, which unavoidably eases the movement.

In conclusion, these and other additional circumstances, can cause some reading errors in a manufacturing cycle, and consequently, obtaining the desired bending angle with precision is made difficult.

WO-A-98/58753 discloses a press brake incorporating a bending angle measuring device with a fork for the bending angle measurement on four points in said press brake, the bending angle measuring device being provided along a matrix or matrix fractionated element, and suitable to detect the real inclination of the two specular planes of the pressed-bent sheet, each having two detection points, one of which is static and known and the other one is dynamic, said fork including a forked end and a relatively shank which interacts with a position transducer, communicating with a data processing logic unit that manages the press brake.

An aim of this invention is to reach an optimisation of the bending angle measuring forked device.

SUMMARY OF THE INVENTION

This and other aims are reached with this innovation according to the characteristics as in the included claims, solving the arising problems by means of an improved fork of the self-centring oscillating type, particularly for the bending angle measuring on four points, in a bending-pressing machine including at least one fork provided along a matrix or matrix fractionated element, suitable to detect the real inclination of the two specular planes of a pressed-bent sheet, each interested by two detection points one of which is static and known and the other one is dynamic, said fork, including a forked end and a relative shank which interacts with a position transducer, communicating with a data processing logic unit that manages the press brake, said fork being hinged in correspondence of said shank top.

Through the considerable creative contribution whose effect constitutes an immediate technical progress different advantages are achieved.

Advantages

In particular, the main problem related to the reading inaccuracy, pointed out in the former case in which, for the bending angle detection, a monolithic fork was provided, has been solved.

As it was observed, this is made possible in that the fork is hinged to the shank, allowing in this way to adjust the measuring means to the sheet independent movement, and consequently giving a high precision degree to the acquisition of the relative data.

These, and other advantages will appear from the following specific description of a preferred solution with the aid of the enclosed schematic drawings, whose execution details are not to be considered limiting but only illustrative.

FIG. 1., shows a view in detail of one of the sheet-plate working process steps, taken in correspondence of the matrix or matrix fractionated element, including a bending angle metering device made up of a fork shaped feeling means.

Figure 2:
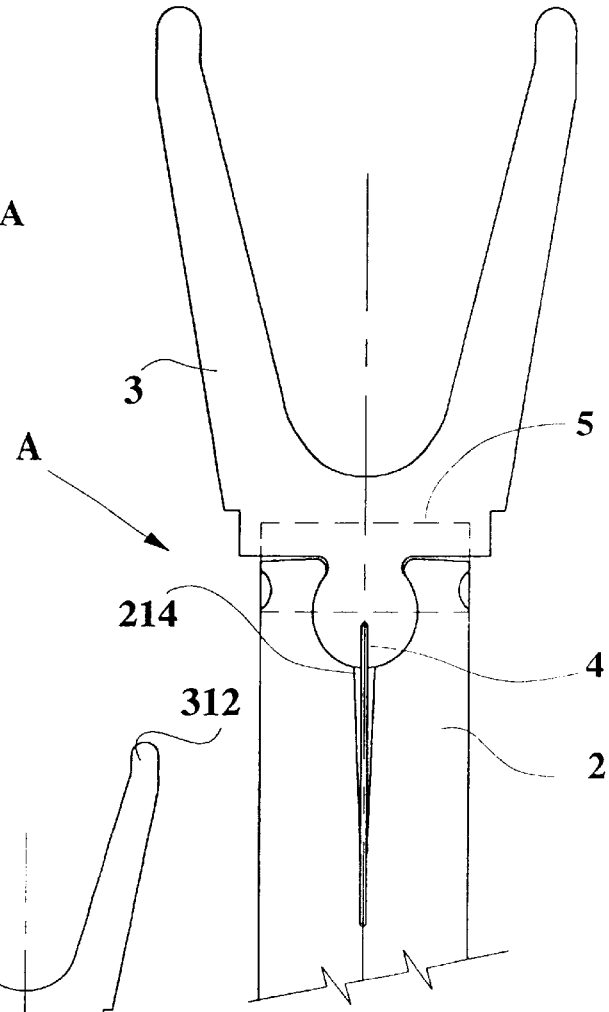

FIG. 2., shows a detailed view of an end of the sole feeler means as in FIG. 1.

Figure 3:
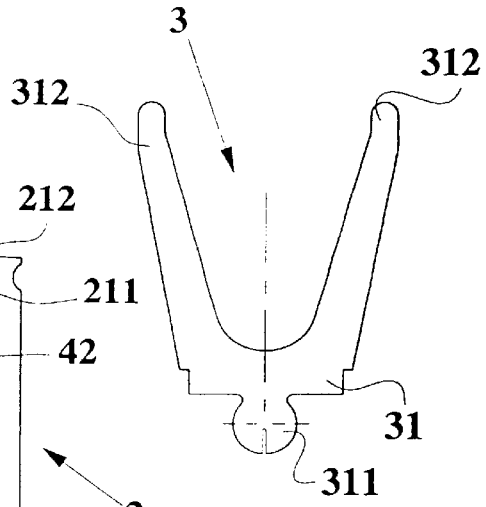

FIG. 3., shows a further detailed view of the sole fork as a part of the feeler means as in FIG. 2.

Figure 4:
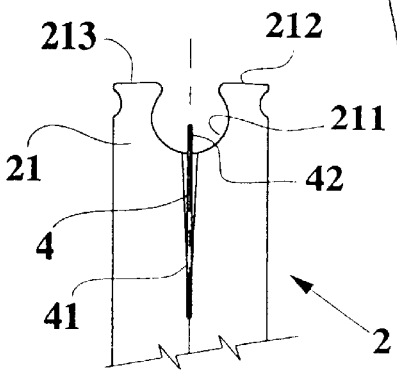

And finally, FIG. 4., shows always a detailed view of the sole top of the shank, as a part of the feeler means as in FIG. 2.

DESCRIPTION OF AN EMBODIMENT EXAMPLE

Considering the figures, it can be observed that in a press brake, in correspondence of an upper cross-beam that supports and moves the relative rammer, a support bench of a matrix (1) of the interchangeable type is provided. In this case, said matrix (1) is provided of a longitudinal hollow (11), and can include at least one fractionated element, for normally short or long pieces, and two or more for long pieces, in order to increase the detection precision, which pieces, being eventually placed at the ends, participate longitudinally, to make up the continuity of the longitudinal hollow. In more detail, each matrix (1) or its fractionated element is preferably made up of a metal monolithic block, longitudinally fastenable on the lower cross-beam top that is on the bench, or more commonly substantially shaped like an overturned "T".

In the shown solution, the matrix (1) it is of the type including a hollow with negative shape, essentially "V"-like (11), obtained by an externally squared body, whose top realises for each part, opposite detection points. These latter ones, being static make up the known points necessary to the logical unit, together with the dynamic points of a forked means (A), for the determination of the sheet bending angle subjected to a pressing-bending cycle.

In this case, on the inside of said hollow (11), of a correspondent matrix (1), is axially movable, that is perpendicularly with respect to the sheet (B), at least one fork (A). This, provides a shank (2), which co-operates with a position transducer, communicating with a data processing logic unit that manages the press brake. On the top (21) of the shank (2) a semicircular seat (211), whose arc portion is greater than 180°, with the two rounded mouth ends is obtained. On the side of the mouth of the semicircular seat (211), two tilted planes, respectively right one (212) and left one (213), and this only in order to allow a controlled oscillation of the above fork (3) are provided. This, is made up of a base (31), from which protrudes, downwardly, a so-called knee-like semi-round head (311), which is butted inside of said receptacle (211), provided on the shank top (2). On the opposite side, always from the base (31), two prongs, specular, (312), lightly wide apart, protrude to form the fork, on whose ends the dynamic points which co-operate with the static points provided on the matrix (1), to the bending angle reading are found.

In order to give an optimal position that is of reference of the fork (3) with respect to the shank (2), it is provided that in absence of stresses, the same remains in a substantially centred condition. This, is reached, by realising, along the shank (2) a conic slot (214), inside of which is to be introduced and anchored with the lower end 1 (41) a plate of equal thickness (4), made up of harmonic steel. The upper end (42), of said plate (4), exceeds the length of said slot (214), so partially interesting the receptacle (211). In this way, the end (42) is received into a notch, previously obtained, radially, as regards the head (311) of the fork (3).

Finally, and with the only one purpose to fasten the fork (3) to the shank (2), preventing its extraction, transversely to them, a retaining plate (5), which being passing-through, concerns both parts of the components, respectively base (31) of the fork (3), top (21) of the shank (2), may be introduced.

What is claimed is:

1. A press brake incorporating a bending angle measuring device for a bending angle measurement in a pressing-bending machine, provided along a matrix element for detecting an inclination of two specular planes of a pressed-bent sheet, each having two detection points, one of which being static and the other one being dynamic, said press brake comprising a fork including a forked end and a shank at an opposite end from the forked end for interacting with a position transducer and for communicating with a data processing logic unit managing the press brake, said fork being self-centering and being hinged at the opposite end in correspondence with a top of said shank.

2. The press brake incorporating a bending angle measuring device according to claim 1, wherein on a top of the shank a semicircular seat, whose arc portion is greater than 180°, is provided to hinge said fork to the shank.

3. The press brake incorporating a bending angle measuring device according to claim 2, wherein the fork is made up of a base from which, downwardly, a semi-round head, to be inserted in said semicircular seat for hinging said fork is provided.

4. The press brake incorporating a bending angle measuring device according to claim 3, wherein from the base, oppositely to the semi-round head, two prongs, specular, protrude to form the fork.

5. The press brake incorporating a bending angle measuring device according to claim 3, wherein on an open top of the semicircular seat, two tilted planes are provided.

6. The press brake incorporating a bending angle measuring device according to claim 3, wherein along said shank a conic slot is provided, inside of which is introduced and anchored with a lower end a plate, made of spring steel, having an upper end exceeding a length of said slot, and partially regarding said semicircular seat, where said plate is received radially to said semi-round head of said fork.

7. The press brake incorporating a bending angle measuring device according to claim 3, wherein transversely intersecting both of said base of said fork and said top of said shank, a retaining plate is inserted.

* * * * *